US005640372A

United States Patent [19]

Thackara

[11] Patent Number: 5,640,372

[45] Date of Patent: Jun. 17, 1997

[54] ROTATIONALLY SYMMETRIC TIMEPIECE

[76] Inventor: John I. Thackara, 655 S. Fairoaks Ave., Apartment D-317, Sunnyvale, Calif. 94086

[21] Appl. No.: 634,870

[22] Filed: Apr. 19, 1996

[51] Int. Cl.[6] ..... G04B 19/00; G04C 21/00

[52] U.S. Cl. ..... 368/76; 368/223

[58] Field of Search ..... 368/62, 76, 78, 368/222, 223, 235

[56] References Cited

U.S. PATENT DOCUMENTS

| | | | |
|---|---|---|---|
| 1,776,001 | 9/1930 | Konigsberg | 368/235 |
| 2,221,413 | 1/1940 | Schanz | 368/76 |
| 2,243,343 | 5/1941 | Johnson | 368/222 |
| 3,616,643 | 11/1971 | Maue | 58/127 |
| 3,780,526 | 12/1973 | Maue | 58/126 R |
| 3,849,978 | 11/1974 | Davis | 368/223 |
| 4,092,823 | 6/1978 | Shiro | 58/125 C |
| 4,138,626 | 2/1979 | Unotoro et al. | 315/169.4 |
| 4,400,092 | 8/1983 | Piquet et al. | 368/82 |
| 4,858,209 | 8/1989 | Chaut | 348/223 |
| 5,199,006 | 3/1993 | Ferrara | 368/76 |

*Primary Examiner*—Vit W. Miska

*Attorney, Agent, or Firm*—Claude A. S. Hamrick

[57] ABSTRACT

A rotationally symmetric timepiece wherein time information is displayed along an axis that is marked in 13 locations with axially symmetric markers. The 13 markers divide the axis into 12 sections of preferably equal length as well as mark the ends of the axis. Time information is displayed by one or more indicators which move along the axis at controlled rates. To display hour information, an indicator, which encircles the axis, is moved along the axis at a speed such that it travels the full length of the axis in a 12-hour period. At the end of this period, the indicator is preferably reset back to the first indicator. To display minute and second information, two additional indicators are used. The minute indicator is made to travel the length of the axis every hour before being reset, while the second indicator travels the length of the axis over a period of one minute before it is reset. The indicators are of different diameters so they do not interfere with each other as they travel along the axis.

25 Claims, 6 Drawing Sheets

ROTATIONALLY SYMMETRIC TIMEPIECE

BACKGROUND OF THE INVENTION

1. Field of the Invention

The present invention relates generally to timepieces of the analog type, and more particularly to an analog timepiece which can be viewed from substantially any angle about a particular axis without loss of precision.

2. Brief Description of the Prior Art

Current timepieces, analog as well as digital, are capable of displaying time information with precisions down to the second or below. Most current displays, however, including most analog and digital displays, are effective only when viewed from a narrow range of angles about the direction normal to the face of the timepiece. At best, conventional clock displays such as dial plate or numbered displays can only be viewed at angles within 90° of the direction normal to the display face. Usually, the range of viewing angles is less than ±90°. An hourglass is an example of an analog display that can be viewed through a full 360° range about the vertical axis passing through the indicator substance passageway from upper chamber to lower chamber. In the case of an hourglass, this range of viewing angles is ordered around the vertical axis of the timepiece. However, for obvious reasons, precise display of time information, such as the time of day in terms of hours, minutes, and seconds, is very difficult to achieve with timepieces based on the hourglass principle.

SUMMARY OF THE INVENTION

It is therefore an object of the present invention to provide an analog horological display device having geometry that can both precisely display time information and be viewed from any direction about its main axis.

It is also the object of the present invention to provide an analog timepiece that can both precisely display time information and be viewed from any direction about a vertical axis.

According to a preferred embodiment of the present invention, time information is displayed along an axis that is marked in 13 locations with axially symmetric markers. The 13 markers divide the axis into 12 sections of preferably equal length as well as mark the ends of the axis. Time information is displayed by one or more indicators which move along the axis at controlled rates. To display hour information, an indicator, which encircles the axis, is moved along the axis at a speed such that it travels the full length of the axis in a 12-hour period. At the end of this period, the indicator is preferably reset back to the first indicator. To display minute and second information, two additional indicators are used. The minute indicator is made to travel the length of the axis every hour before being reset, while the second indicator travels the length of the axis over a period of one minute before it is reset. The indicators are of different diameters so they do not interfere with each other as they travel along the axis.

DESCRIPTION OF THE PREFERRED EMBODIMENTS

Figure 1:
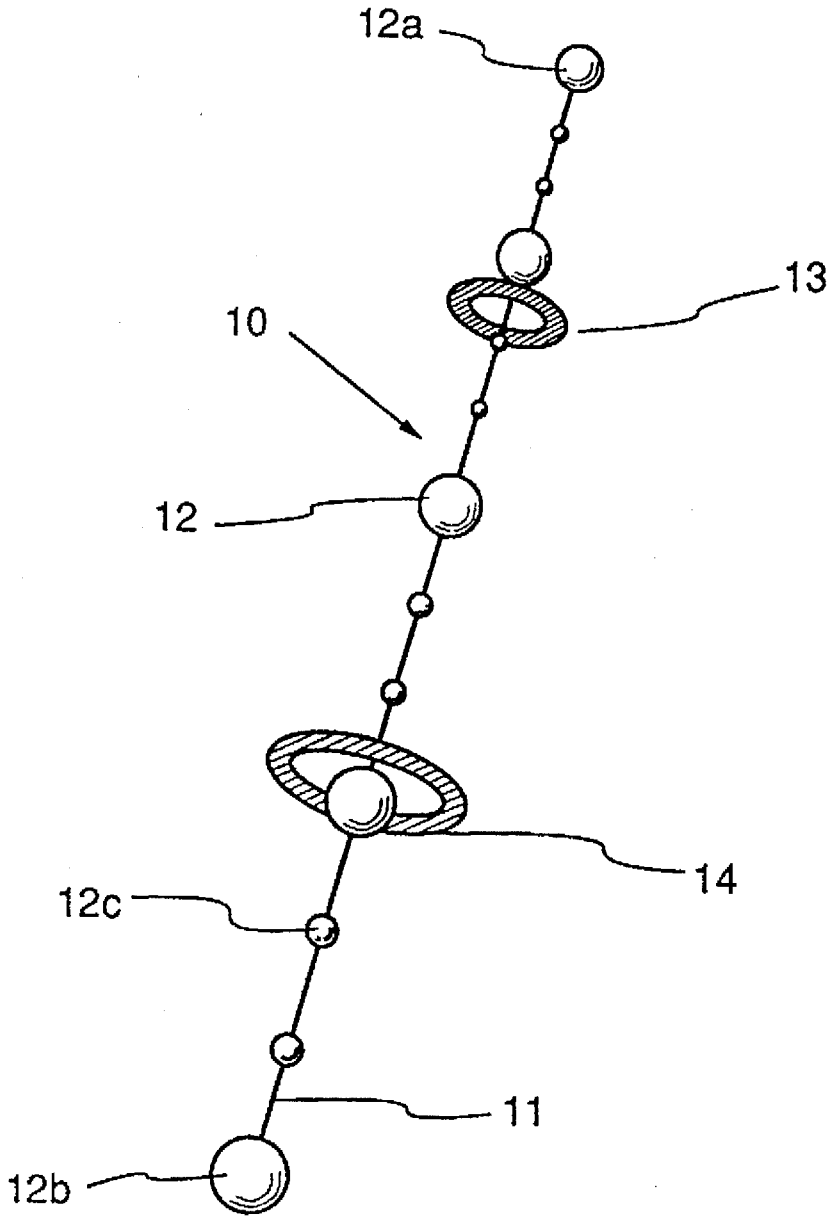
FIG. 1 is a schematic view of a rotationally symmetric time display comprised of the time axis, time markers, and time display indicators, and suggesting the overall concept of the present invention.

An example of the rotationally symmetric time display geometry 10 forming the basis of the present invention is shown in FIG. 1. The elongated time axis 11 is divided into twelve sections by thirteen axially symmetric markers 12. To facilitate the reading of time, five of the markers are larger than the other eight. Two of the larger markers **12*a* and 12*b* mark the start and end of the time axis 11, while the other three are positioned to divide the time axis 11 into four equal length sections. The smaller markers 12*c* are positioned to further divide the time axis 11 into twelve equal length sections. Time of day information in terms of hours and minutes is displayed by the time indicators 13 and 14. Hour information is displayed by the hour indicator 13, which is made to travel the length of time axis 11 at a uniform rate over a twelve hour period. When the hour indicator 13 reaches the last marker 12*b* after twelve hours of travel, it is preferably reset back to the first marker 12*a* at the start of the time axis 11. Minute information is displayed by the minute indicator 14, which is made to travel the length of time axis 11 at a uniform rate over a one hour period. When the minute indicator 14 reaches the last marker 12*b* after one hour of travel, it is reset back to the first marker 12*a* at the start of the time axis 11. In the example shown in FIG. 1**, a time of day of approximately 3:44 is displayed.

Although in the foregoing description the markers are depicted as spheres, other axially symmetric shapes, such as disks or bands, could be used for the markers. Even other shapes which are not perfectly symmetrical about an axis, such as triangles, squares, or octagons, could be used for the markers without significantly compromising the viewability of the time display from all directions about the main axis of the display.

Furthermore, although in the foregoing description the time indicators are depicted as rings, other axially symmetric shapes, such as bands, could be used for the indicators. Even other shapes which are not perfectly symmetrical about an axis, such as triangles, squares, or octagons, could be used for the time indicators without significantly compromising the viewability of the time display from all directions about the main axis of the display.

Moreover, although in the foregoing description the time axis is divided into twelve equal length sections, additional markers could be used to divide the time axis into a different number of sections such as 24.

Figure 2:
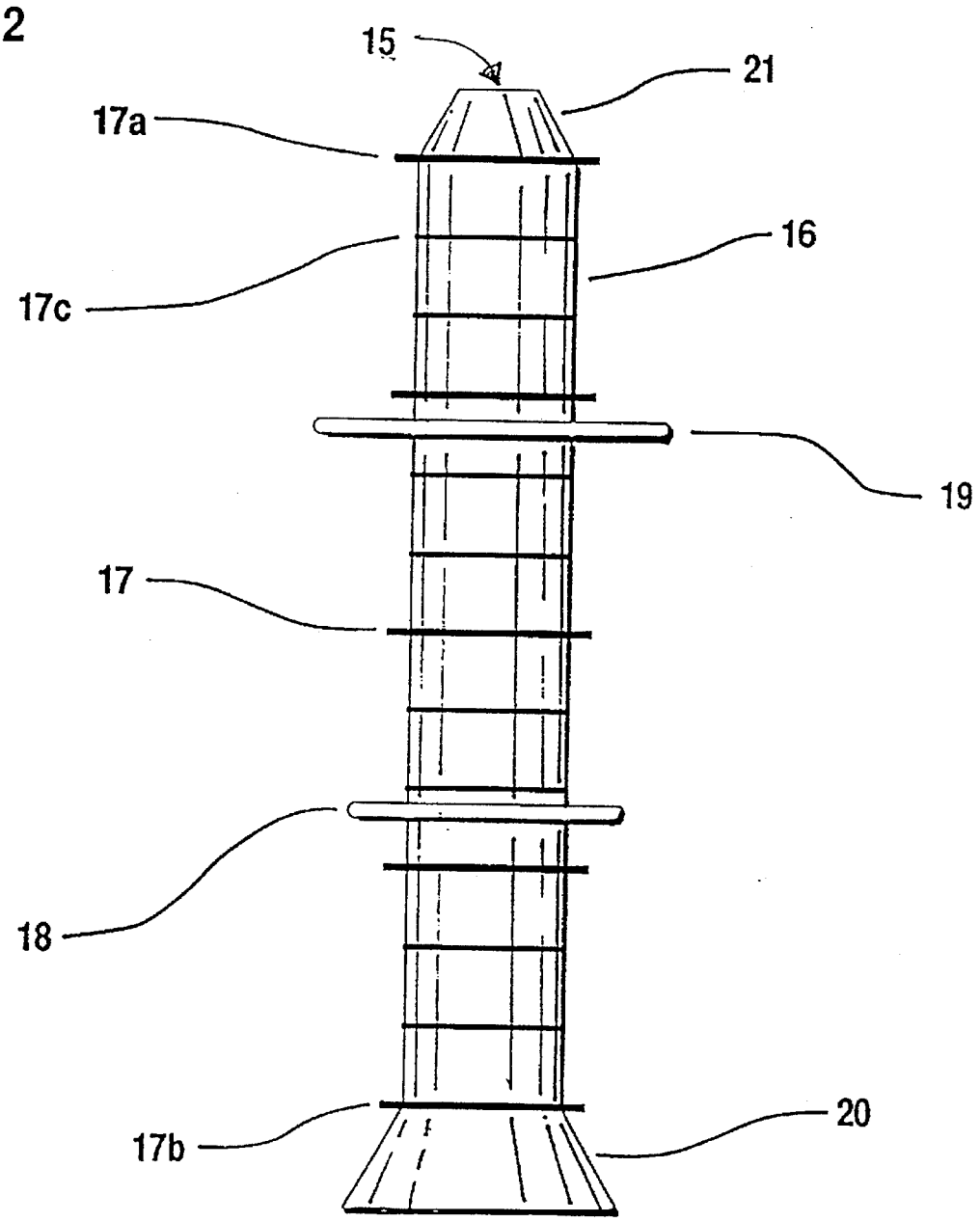
FIG. 2 is a side view of one embodiment of a rotationally symmetric timepiece in accordance with the present invention and composed of a central column with 13 markers and two indicators for displaying time of day information in terms of hours and minutes.

One example of a rotationally symmetric analog timepiece 15 based on the rotationally symmetric time display geometry 10 of FIG. 1 is shown in FIG. 2. In this timepiece 15, a column 16 serves as the time axis, and is divided into twelve equal length sections by thirteen markers 17. To facilitate the reading of time, five of the markers are made thicker and extend farther from the column than the other eight. Two of the larger markers 17*a* and 17*b* mark the top and bottom of the column 16, and serve as the start and end of the time axis respectively. The other three larger markers are positioned to divide the column 16 into four equal length sections. The smaller markers 17*c* are positioned to further divide the column 16 into twelve equal length sections. Time of day information in terms of hours and minutes is displayed by the time rings 18 and 19. Hour information is displayed by the hour ring 18, which is made to travel the length of the column 16 at a uniform rate over a twelve hour period. When the hour ring 18 moves downwardly from the first marker 17*a* and reaches the last marker 17*b* after twelve hours of travel, it is reset back to its starting position at the first marker 17*a* at the top of the column 16. Minute information is displayed by the minute ring 19, which is made to travel the length of the column 16 at a uniform rate over a one hour period. When the minute ring 19 reaches the last marker 17*b* after one hour of travel, it is reset back to its starting position at the first marker 17*a* at the top of the column 16. In the example shown in FIG. 2, a time of day of approximately 8:17 is displayed. The column 16 is held in an upright position by a base 20, and the top of the column is covered by a cap 21.

Figure 3:
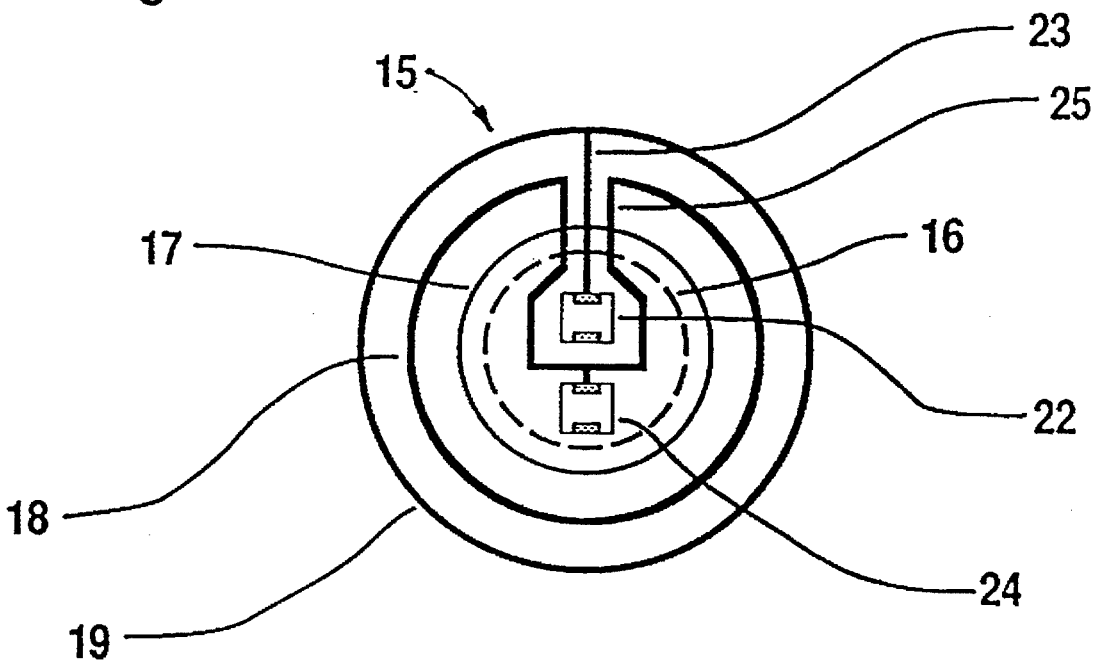
FIG. 3 is a top view of the timepiece of FIG. 2, showing the means by which the two time indicators move without interfering with each other.

As shown in FIG. 3, the two time rings 18 and 19 of the timepiece 15 of FIG. 2 are designed so that they can travel up and down the column 16 without interfering with each other or with the markers 17. Specifically, the hour ring 18 is designed with an inner diameter that is larger than the outer diameter of the largest markers 17. The minute ring 19 is designed with an inner diameter that is larger than the outer diameter of the hour ring 18. As will be described in more detail below, minute and hour control mechanisms 22 and 24 are disposed within the column 16. The minute ring 19 is connected to the minute control mechanism 22 by a minute control arm 23. The hour ring 18 is connected to the hour control mechanism 24 by a pair of hour control arms 25. The minute and hour control mechanisms 22 and 24 are positioned so that the hour control arms 25 can connect to the hour control mechanism 24 without interfering with the minute control mechanism 22 or the minute control arm 23 as each moves back and forth between the top and bottom of the column 16.

Figure 4:
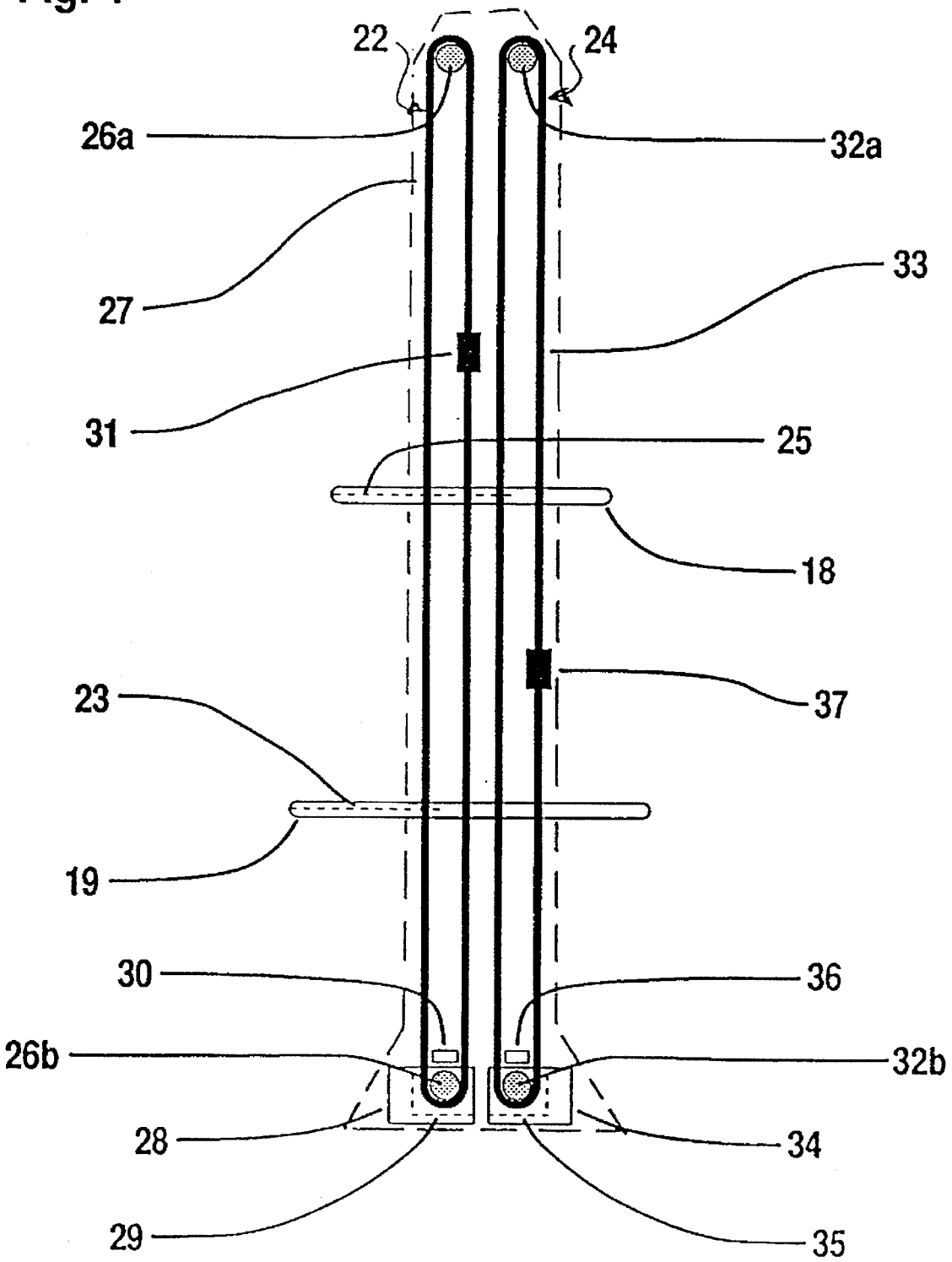
FIG. 4 is a perspective view that shows the drive mechanisms for the hour and minute time indicators of the timepiece of FIG. 2.

Examples of the minute and hour control mechanisms 22 and 24 of the timepiece 15 of FIG. 3 are shown in FIG. 4. The minute control mechanism 22 is composed of two minute wheels 26*a* and 26*b* which support a minute band 27. The minute ring 19 is attached to the minute band 27 by the minute control arm 23. The lower minute wheel 26*b* is rotated by the minute drive mechanism 28 at a controlled rate so that the minute ring 19 moves downward and traverses its full length of travel in a period of one hour. The minute drive mechanism 28 is connected to the lower minute wheel 26*b* by the minute clutch 29 which is controlled by the minute sensor mechanism 30 and is normally engaged. Respectively attached to the bands 27 and 33 are weights 31 and 37 which serve the dual purposes of providing (1) clutch engagement means, and (2) ring return means. When the minute control arm 23 contacts the minute sensor mechanism 30, the minute clutch 29 is disengaged. When the minute clutch 29 is disengaged, the minute wheels 26*a* and 26*b* are free to rotate allowing the minute weight 31 to drop until it contacts the minute sensor mechanism 30. As it drops, weight 31 pulls the minute ring 19 back up to its starting position. When the minute weight 31 contacts the minute sensor mechanism 30 the minute clutch 29 is re-engaged allowing the minute ring 19 to begin its downward motion, again displaying minute information. The hour control mechanism 24 is similar to the minute control mechanism 33. The hour ring 18 is attached to the hour band 33 by the hour control arms 25. The lower hour wheel 32*b* is rotated by the hour drive mechanism 34 at a controlled rate so that the hour ring 18 moves downward and traverses its full length of travel in a period of twelve hours. The hour drive mechanism 34 is connected to the lower hour wheel 32*b* by the hour clutch 35 which is controlled by the hour sensor mechanism 36 and is normally engaged. When either one of the hour control arms 25 contacts the hour sensor mechanism 36, the hour clutch 35 is disengaged rendering the hour wheels 32*a* and 32*b* free to rotate and allowing the hour weight 37 to drop until it contacts the hour sensor mechanism 36. As weight 37 drops, it pulls the hour ring 18 back up to its starting position. When the hour weight 37 contacts the hour sensor mechanism 36, the hour clutch 35 is re-engaged allowing the hour ring 18 to begin its travel down the column and again display hour information.

Although in the foregoing illustration and description only hour and minute information are disclosed, it is also possible to add a third ring and control mechanism to display second information.

Whereas in the foregoing description the clutches are controlled by the sensor mechanisms, it is also possible to control the clutches with an external timing and control mechanism.

Similarly, whereas in the foregoing description the time rings are controlled by drive mechanisms which are each composed of two wheels and a band, it is also possible to control the time rings with alternate control mechanisms.

Moreover, although in the foregoing description neither the markers nor the rings are illuminated, it is also possible that either the markers or the rings, or both, could be made luminous to facilitate the reading of time information without external illumination of the timepiece. In addition, or in the alternative, the column 16 could be illuminated.

As described above, this invention provides a rotationally symmetric time display geometry which allows for a precise display of time information that is viewable from any direction about its main axis. This invention further provides an analog timepiece that can both precisely display time information and that can be viewed from any direction about a vertical axis. This type of timepiece is suitable for use as a stand alone analog time display or for use in incorporating the rotationally symmetric time display geometry into other objects such as the base of a lamp. Both the markers and the indicators can be made luminous to facilitate the reading of time information when the ambient lighting is low.

Even though the present invention has been described above as having equal spacing between time markers, with rings traveling at uniform rates down the column, it will be appreciated that there might be applications in which one would, for variation of effect, or other reasons, want to have different spacings between the hour markers and provide variable rate drive means that would appropriately change the rate of movement of the rings as they are moved along the column so that they move at rates proportional to the spacings between markers as they transit such space. Such rate changes could for example be effected by appropriately programming electronic stepper motors used in the drive mechanisms.

Another variation might be to cause the hour indicator to rise from the bottom to the top of the column during the AM hours and to move from the top to the bottom during the PM hours, perhaps using a flag of some type, or a change in lighting or color, etc., to indicate AM/PM periods.

Figure 5:
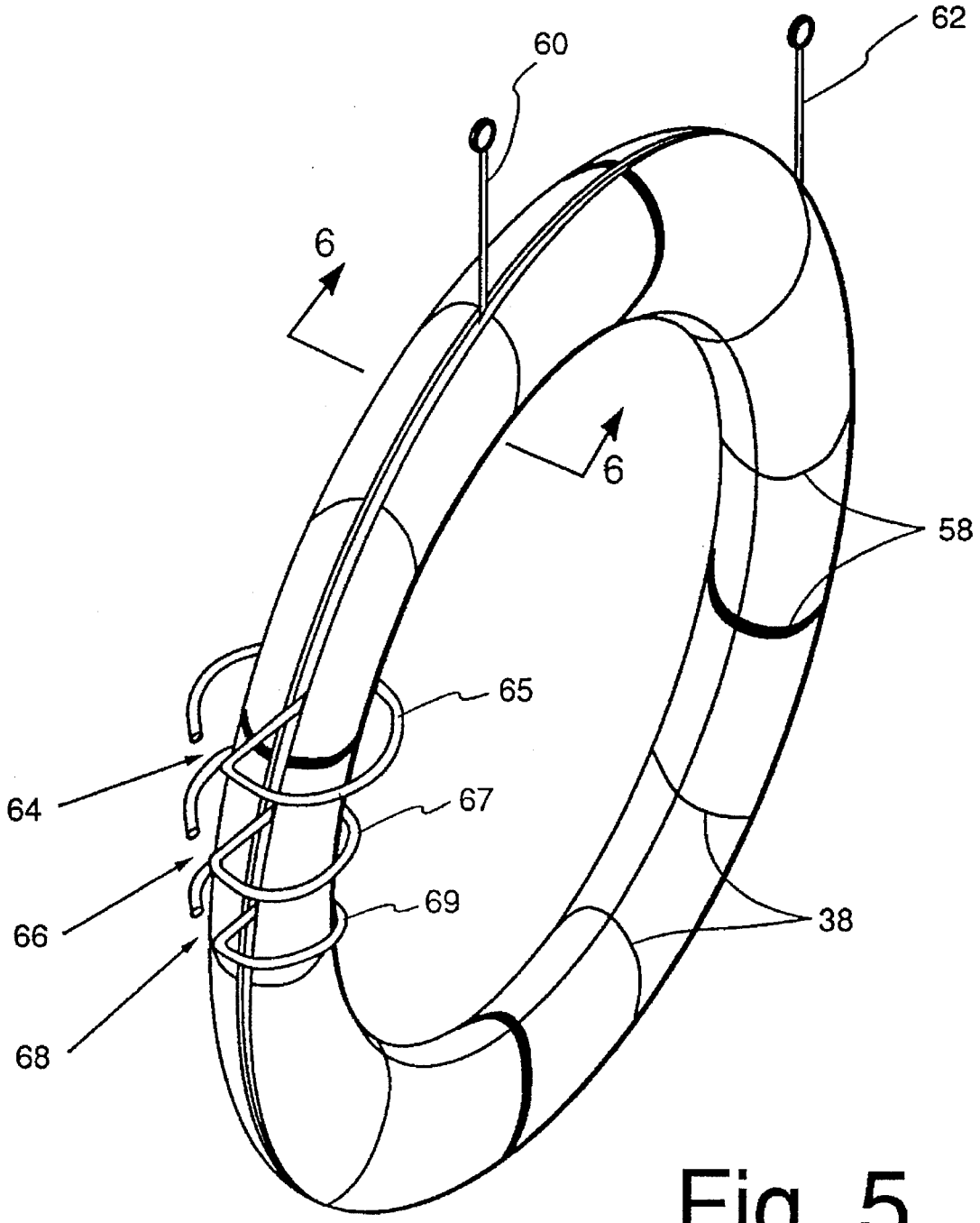
FIG. 5 is a perspective view illustrating an alternative embodiment of the present invention.
Figure 6:
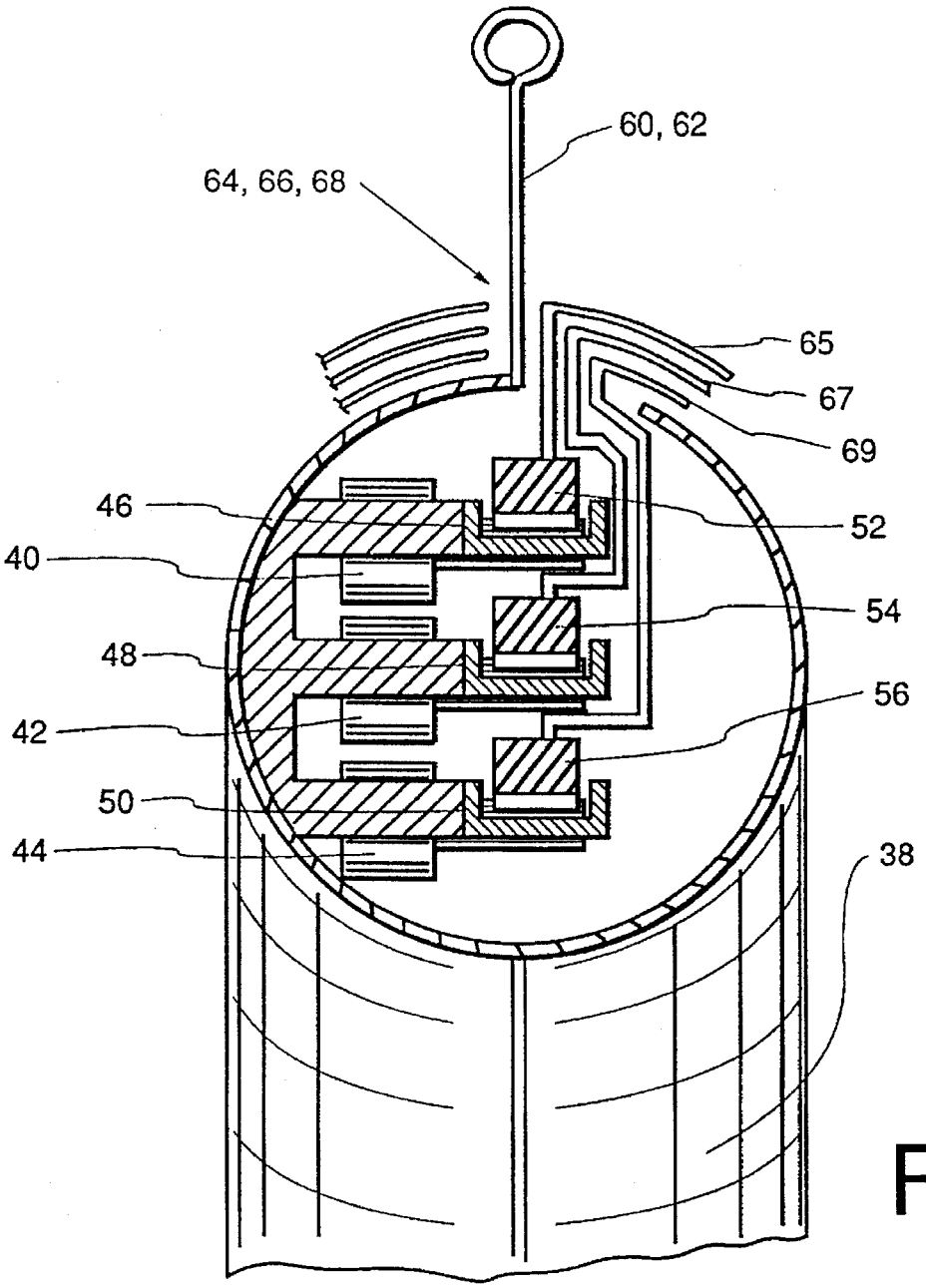
FIG. 6 is a cross-section taken along the line 6—6 in FIG. 5.

In an alternative embodiment such as that depicted in FIG. 5 of the drawing, and in FIG. 6 (a cross-section taken along the line 6—6 in FIG. 5), the time axis might be made curved or endless; e.g., the "column 16" might be folded end-to-end and connected to form a circular loop 38 or other ellipse. In such case, suitable toothed belt drive motors 40, 42, 44 and belt guides 46, 48, 50 would be provided for facilitating movement of second, minute and hour ring-carrying belts 52, 54, 56 around the loop. And as in the previously described embodiment, suitable markers 58 may be placed at predetermined intervals around the loop marking off 12 (or 24) hours of time as well as intervening minutes and/or seconds if desired. The loop might be hung from hangers 60 and 62 which are cleared by the gaps 64, 66, 68 in the rings 65, 67, 69 as they pass around the loop. Although this embodiment is not strictly viewable from 360°, it is readable from nearly all angles outside the plane of the loop.

While the invention has been described in terms of specific examples and specific embodiments, it is to be understood that this invention is not limited to these specific examples and embodiments and that many changes and modified embodiments will be apparent to those skilled in the art without departing from the true spirit and scope of the invention.

What is claimed is:

1. Horological display apparatus having a rotationally symmetric time display geometry comprising:

means forming an elongated time axis;

a plurality of axially symmetric markers positioned along said time axis to divide said time axis into a plurality of segments, axially symmetric hour and minute indicators, a first group of said markers being larger than a second group of said markers, said markers being positioned along said time axis to divide said time axis into a plurality of equal length sections to facilitate the reading of time in terms of hours and minutes, two of said markers being positioned at the ends of said time axis to mark the start and end of said time axis, said indicators encircling said time axis and made to travel along said time axis at controlled rates so that their positions along said time axis provide a display of time in terms of hours and minutes, said hour indicator having an inner diameter larger than the outer diameter of said first markers and made to travel the length of said time axis over a twelve hour period to display time information in terms of hours, said hour indicator being reset to a start of time position after reaching the end of time position, said minute indicator having an inner diameter larger than the outer diameter of said hour indicator and made to travel the length of said time axis over a one hour period to display time information in terms of minutes, said minute indicator being reset to said start of time position after reaching said end of time position.

2. Horological display apparatus as recited in claim 1 wherein a third axially symmetric indicator is provided to display time information in terms of seconds, said third indicator being made to travel the length of said time axis over a one minute period, said third indicator being reset to said start of time position after reaching said end of time position, said third indicator having inner and outer diameters such that it does not interfere with said markers or said hour and minute indicators as it travels along said time axis.

3. Horological display apparatus as recited in claim 1 wherein said markers are of a polygonal shape that is not perfectly symmetric about said time axis.

4. Horological display apparatus as recited in claim 1 wherein said indicators are of polygonal shapes that are not perfectly symmetric about said time axis.

5. Horological display apparatus as recited in claim 1 wherein said markers and said indicators are of different relative sizes and have inner and outer diameters of sizes such that said indicators can travel along said time axis without interfering with each other or with said markers.

6. Horological display apparatus as recited in claim 1 wherein said time axis is divided into a number of sections other than twelve.

7. A rotationally symmetric timepiece comprising a time column, thirteen axially symmetric markers, and hour and minute time rings, said markers being positioned along said column to divide it into twelve equal length sections, five of said markers being thicker and extending farther from the column than the other eight and being positioned along said column to divide it into four equal length sections to facilitate the reading of time in terms of hours and minutes, two of said thicker axially symmetric markers being positioned at the top and bottom of said column to mark the start and end of a time axis that said time column represents, said time rings encircling said column and being made by drive means to travel down said column at controlled rates so that their positions along said column provide a display of time in terms of hours and minutes, said hour time ring having an inner diameter larger than the outer diameter of said thicker axially symmetric markers and being made to travel the length of said column over a twelve hour period to display time information in terms of hours, said hour time ring being reset to the top of said column after reaching the bottom of said column after twelve hours of travel, said minute time ring having an inner diameter larger than the outer diameter of said hour time ring and being made to travel the length of said column over a one hour period to display time information in terms of minutes, said minute time ring being reset to the top of said column after reaching the bottom of said column after one hour of travel.

8. A rotationally symmetric timepiece as recited in claim 7 and further comprising means associated with said drive means and operative to indicate AM or PM.

9. A rotationally symmetric timepiece as recited in claim 7 wherein a third time ring is provided to display time information in terms of seconds, said third time ring made to travel the length of said column over a one minute period, said third time ring being reset to the top of said column after reaching the bottom of said column after one minute of travel, said third time ring having inner and outer diameters such that said third time ring does not interfere with said markers or said hour and minute rings as it travels along said column.

10. A rotationally symmetric timepiece as recited in claim 7 wherein said markers are of a polygonal shape that is not perfectly symmetric about said column.

11. A rotationally symmetric timepiece as recited in claim 7 wherein said time rings are of polygonal shapes that are not perfectly symmetric about said column.

12. A rotationally symmetric timepiece as recited in claim 7 wherein said markers and said time rings are of different relative sizes having inner and outer diameters of the proper relative sizes so that said time rings can travel along said column without interfering with each other or with said markers.

13. A rotationally symmetric timepiece as recited in claim 7 wherein said column is divided into a number of sections other than twelve.

14. A rotationally symmetric timepiece as recited in claim 7 wherein said column is held at an angle other than vertical.

15. A mechanism for controlling the position of hour and minute time rings along a time column to display time information in terms of hours and minutes comprising:

a minute control arm;

two hour control arms;

hour and minute bands;

two minute and two hour wheels;

hour and minute weights and sensors; and hour and minute drives and clutches;

said minute control arm being attached to said minute band and said minute time ring, said minute band being looped around said minute wheels, the bottom of said minute wheels being driven at a controlled rate through said minute clutch by said minute drive so that said minute time ring moves downward and traverses the full length of said column in a period of one hour, said minute sensor disengaging said minute clutch when said minute control arm contacts said minute sensor thereby allowing said minute weight to drop until it contacts said minute sensor and pulls said minute time ring back up to its starting position at the top of said column, said minute sensor re-engaging said minute clutch when contacted by said minute weight thereby allowing said minute time ring to continue to display time information in terms of minutes, said hour control arms being attached to said hour band and said hour time ring, said hour control arms being arranged on either side of the plane containing said minute control arm and the axis of said time column so that said hour control arms do not interfere with said minute control arm or said minute wheels, band, weight, and sensor;

said hour band being looped around said hour wheels, the bottom of said hour wheels being driven at a controlled rate through said hour clutch by said hour drive so that said hour time ring moves downward and traverses the full length of said column in a period of twelve hours, said hour sensor disengaging said hour clutch when either of said hour control arms contacts said hour sensor allowing said hour weight to drop until it contacts said hour sensor and pulls said hour time ring back up to its starting position at the top of said column, said hour sensor re-engaging said hour clutch when contacted by said hour weight thereby allowing said hour time ring to continue to display time information in terms of hours.

16. A mechanism for controlling the position of hour and minute time rings as recited in claim 15 wherein another mechanism is added to control the position of a third time ring along said column to display time information in terms of seconds.

17. Horological display apparatus, comprising:

means forming a time axis;

a first axially symmetric time indicator disposed concentric with said time axis and movable therealong to identify a first measure of time as a function of its position along said time axis;

a second axially symmetric indicator disposed concentric with said time axis and movable therealong to signify as a function of its position along said time axis a second measure of time fractionally related to said first measure of time; and means for driving said first and second indicators along said time axis at predetermined rates such that their positions relative to each other and/or to said time axis at any point in time indicates a particular measure of time.

18. Horological display apparatus as recited in claim 17 wherein a plurality of markers are disposed along said time axis dividing it into time-defining segments.

19. Horological display apparatus as recited in claim 18 wherein said markers are positioned at regular intervals along said time axis.

20. Horological display apparatus as recited in claim 19 wherein said markers are axially symmetric to said time axis.

21. Horological display apparatus as recited in claim 17 wherein said time axis is enclosed within a tubular housing concentric therewith.

22. Horological display apparatus as recited in claim 21 wherein said means for driving is disposed within said housing and includes a drive belt and motor associated with each said indicator, each said belt being affixed to one of said indicators and operative to carry same along said time axis.

23. Horological display apparatus as recited in claim 22 wherein said tubular housing has a slit in one side thereof running the length of said time axis, said belts being affixed to said indicators by control arms which extend through said slit.

24. Horological display apparatus as recited in any of claims 17–23 wherein said time axis is linear.

25. Horological display apparatus as recited in any of claims 17–23 wherein said time axis is elliptical.

* * * * *